United States Patent [19]

Laveckis

[11] Patent Number: 4,475,253

[45] Date of Patent: Oct. 9, 1984

[54] GARMENT WITH A CONVERTIBLE CUFF

[75] Inventor: Regina G. Laveckis, Westwood, Mass.

[73] Assignee: The William Carter Company, Needham Heights, Mass.

[21] Appl. No.: 523,268

[22] Filed: Aug. 15, 1983

[51] Int. Cl.[3] ..... A41D 27/10

[52] U.S. Cl. ..... 2/269; 2/80; 2/83; 2/232; 2/243 R

[58] Field of Search ..... 2/269, 243 R, 243 A, 2/243 B, 83, 80, 232, 227; 36/110

[56] References Cited

U.S. PATENT DOCUMENTS

| | | | |
|---|---|---|---|
| 904,383 | 11/1908 | Velasko | 2/83 |
| 1,112,759 | 10/1914 | Bissell et al. . | |
| 1,283,205 | 10/1918 | Jones . | |
| 1,393,900 | 10/1921 | Milkes | 2/83 |
| 1,794,850 | 3/1930 | Hatch | 2/83 |
| 2,131,898 | 2/1938 | Milkes | 2/83 |
| 2,552,802 | 5/1951 | Martin | 2/83 |
| 2,655,660 | 10/1953 | Racz | 2/83 |
| 2,705,326 | 4/1955 | Lahnstein et al. . | |
| 3,111,676 | 9/1961 | Artzt et al. | 2/83 |
| 3,381,311 | 5/1968 | Wormser . | |

*Primary Examiner*—Werner H. Schroeder
*Assistant Examiner*—Mary A. Ellis

[57] ABSTRACT

A garment including a pants leg having a convertible cuff at the end of the leg, the convertible cuff including bottom and top pieces of cloth material sewn together at their sides along two seams, the bottom piece having a folded-over heel portion with two folds spaced from an end thereof to provide three flat layers of overlapping cloth when not extended, whereby the convertible cuff can be neatly folded up to provide the appearance of a conventional cuff or can be unfolded and extended to provide a foot covering bent at the top piece and generally transverse to the remainder of the pants leg with the heel portion extending around the heel and providing a good fit over the heel.

3 Claims, 6 Drawing Figures

FIG 1
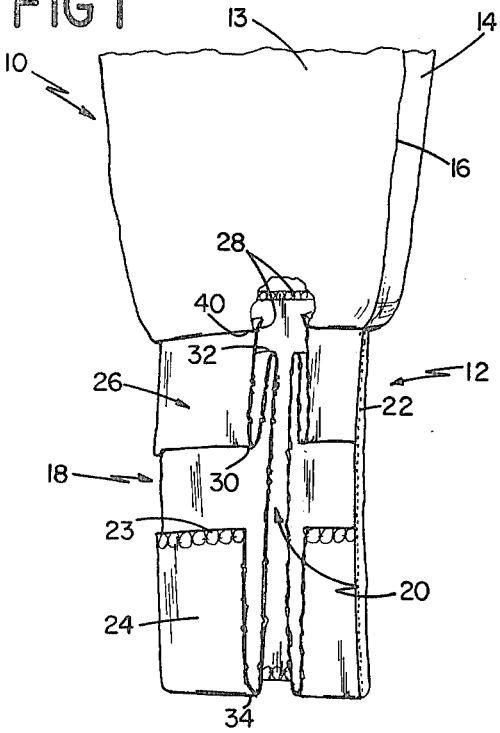
FIG 4
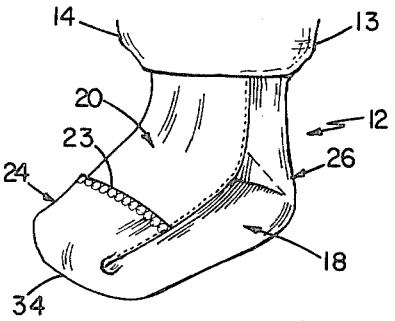
FIG 5
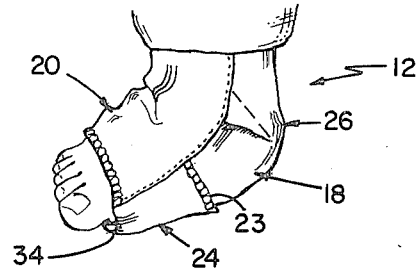
FIG 6
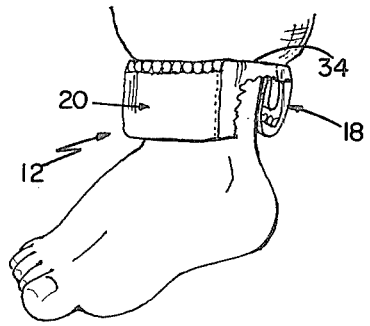
FIG 2
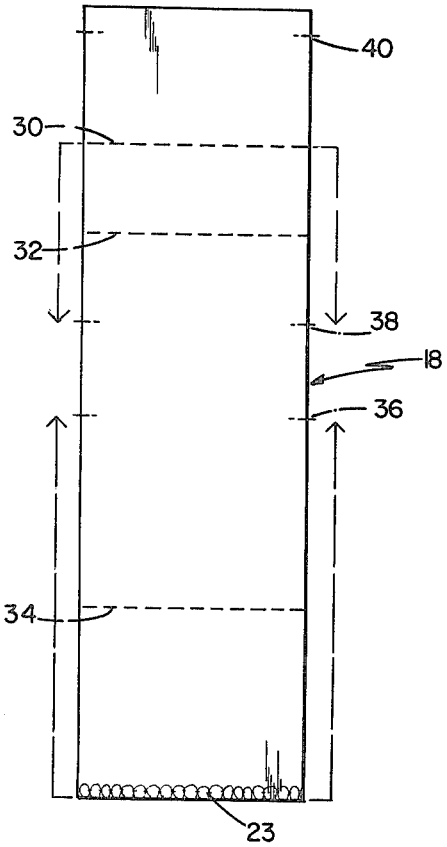
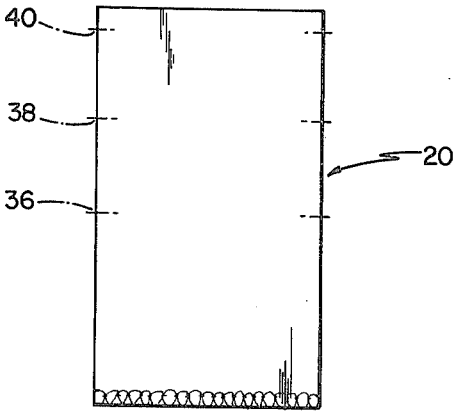
FIG 3

GARMENT WITH A CONVERTIBLE CUFF

FIELD OF THE INVENTION

The invention relates to garments with pants legs.

BACKGROUND OF THE INVENTION

It is sometimes desirable to have garments with pants legs having ends that can cover the foot or that can be pulled back to expose either the toes or the complete foot.

For example, Milkes U.S. Pat. No. 1,393,900 discloses children's pajamas with a removable foot covering including a rear exterior pocket to provide a heel and a front exterior pocket for providing a sole and receiving the rest of the foot. When not covering the foot, the pockets are buttoned to the pants leg.

Artzt U.S. Pat. No. 3,111,676 also discloses a removable foot covering formed of front and back pockets. When not in use as a foot covering, the front and back pockets are folded up inside the fronts and backs of the legs.

Wormser U.S. Pat. No. 3,381,311 discloses a pajama leg with an end that converts from a cuff to a foot covering. A button is employed to hold the end in place during use both as a cuff or as a foot covering.

Other constructions for adjustable foot coverings for pajama legs are disclosed is U.S. Pat. Nos. 2,705,326; 1,283,205 and 1,112,759.

SUMMARY OF THE INVENTION

It has been discovered that a pants leg can be provided with a bottom that easily converts from a cuff to a foot covering that provides good fit over the heel by making the cuff of a top piece of cloth and a bottom piece of cloth sewn together along two edge seams extending toward the end of the pants leg and by providing the bottom piece with a heel portion that has two folds to provide three flat layers of overlapping cloth. When the convertible cuff is used as a cuff, the three layes of cloth in the heel portion are neatly folded over each other with the remainder of the cuff, and the cuff appears to be a conventional cuff. When the cuff is unfolded to provide a foot covering, the top piece bends and is generally transverse to the rest of the pants leg, and the three layers of the heel portion extend in a non-overlapping manner to provide a good fit over the heel.

In preferred embodiments one of the pieces of cloth also includes an folded-over toe portion that is invertible to permit the toes to be covered or exposed; the heel and toe portions are both on the bottom piece of cloth; and remainder of the leg includes a separate piece of cloth sewn to the convertible cuff; and the material between the folds is sewn at the two seams.

DESCRIPTION OF THE PREFERRED EMBODIMENT

The structure and use of the preferred embodiment of the invention will now be described after first briefly describing the drawings.

DRAWINGS

FIG. 1 is a plan view, partially broken away, of a portion of a pants leg of a garment according to the invention.

FIG. 2 is a diagrammatic plan view of the bottom piece of a convertible cuff of the FIG. 1 garment prior to manufacture.

FIG. 3 is a diagrammatic plan view of the top piece of the convertible cuff.

FIGS. 4–6 are perspective views showing the convertible cuff in different positions during use.

STRUCTURE

Referring to FIG. 1, there is shown pants leg 10 with convertible cuff 12 at its end. Leg 10 is made of two pieces of cloth 13, 14 stitched together at seam 16, and convertible cuff 12 is made of bottom piece of cloth 18, and top piece of cloth 20 (shown under bottom piece 18 in FIG. 1) stitched to each other at their sides along seams 22. (Only one seam 22 is shown in the drawings.) The end 23 of cloth piece 18 is folded back at fold 34 to provide folded-over toe portion 24, which is also sewn at its sides at seam 22. The top part of cloth piece 18 has folded-over heel portion 26 that has lower fold 30 and upper fold 32 that provide three flat, overlapping layers of cloth that are also stitched at seams 22 to top piece 20. Lower fold 30 is on the outside, and upper fold 32 is on the inside. Cuff 12 and leg pieces 13, 14 are stitched together at seam 28.

Referring to FIGS. 2 and 3, bottom and top cloth pieces 18, 20 are shown in unfolded positions prior to stitching.

In manufacture, end 23 of piece 18 is brought up to location 36 (as is shown by the arrows on FIG. 2) creating fold 34. The upper part of cloth 18 is folded at folds 30 and 32, and fold 30 is brought down to location 38. Pieces 18 and 20 are then stitched together at the two sides to provide seams 22 with locations 40, 38, and 36 on both pieces of cloth being aligned. Convertible cuff 14 is then stitched to leg pieces 12, 13.

USE

In FIG. 4 convertible cuff 12 is shown used as a foot covering for an infant. Toe portion 24 is in an inverted position overlapping top piece 18 to cover the infant's toes, and heel portion 26 is extended to provide a good fit at the infant's heel.

Toe portion 24 can be inverted as shown in FIG. 5, overlapping bottom piece 18 to expose the infant's toes to permit checking of the infant's circulation.

Convertible cuff 14 can also be folded back as shown in FIG. 6 to provide what appears to be a conventional cuff. The garment can be used in this position even after the infant has grown to the point where the foot is longer than the distance from heel portion 26 to the end of toe portion 24.

OTHER EMBODIMENTS

Other embodiments of the invention will become apparent to those skilled in the art.

What is claimed is:

1. A garment comprising a pants leg having a convertible cuff at the end of said leg, said convertible cuff comprising bottom and top pieces of cloth material sewn together at their sides along two seams, said seams terminating at a position adjacent the base of the toes to provide a forward end opening exposing the toes, said bottom piece having a folded-over heel portion with two folds spaced from an end thereof to provide three flat layers of overlapping cloth when not extended and extendible to form a heel engaging covering, one of said pieces having a toe portion folded rearwardly and outwardly over itself and extending rearwardly to a position short of said heel portion, said folded over toe portion being joined to said side seams along its margins and being capable of being reversed to enclose said forward opening and overlie the forward portion of the other of said pieces.

2. The garment of claim 1 wherein said toe portion is on said bottom piece.

3. A garment as claimed in claim 1 in which said bottom and top pieces are rectangular and said side seams are straight.

* * * * *